US011120815B2

(12) United States Patent
Zhu

(10) Patent No.: US 11,120,815 B2
(45) Date of Patent: Sep. 14, 2021

(54) METHOD AND APPARATUS FOR REDUCING NOISE OF MIXED SIGNAL

(71) Applicant: Nanjing Horizon Robotics Technology Co., Ltd., Nanjing (CN)

(72) Inventor: Changbao Zhu, Nanjing (CN)

(73) Assignee: Nanjing Horizon Robotics Technology Co., Ltd, Nanjing (CN)

( * ) Notice: Subject to any disclaimer, the term of this patent is extended or adjusted under 35 U.S.C. 154(b) by 146 days.

(21) Appl. No.: 16/411,618

(22) Filed: May 14, 2019

(65) Prior Publication Data

US 2019/0355374 A1 Nov. 21, 2019

(30) Foreign Application Priority Data

May 16, 2018 (CN) ..... 201810466106.9

(51) Int. Cl.
*G10L 21/0216* (2013.01)
*G10L 21/0272* (2013.01)

(52) U.S. Cl.
CPC ..... *G10L 21/0216* (2013.01); *G10L 21/0272* (2013.01); *G10L 2021/02166* (2013.01)

(58) Field of Classification Search
CPC ..... G10L 21/0208; G10L 21/0216; G10L 21/0272; G10L 2021/02166
See application file for complete search history.

(56) References Cited

U.S. PATENT DOCUMENTS

| | | | |
|---|---|---|---|
| 7,099,821 | B2 | 8/2006 | Visser |
| 7,487,440 | B2 | 2/2009 | Gergic |
| 2006/0053002 | A1 | 3/2006 | Visser |
| 2008/0181058 | A1 | 7/2008 | Hayakawa |

FOREIGN PATENT DOCUMENTS

| | | | |
|---|---|---|---|
| CN | 101432805 | A | 5/2009 |
| CN | 101901601 | A | 12/2010 |
| CN | 103871420 | A | 6/2014 |
| JP | 2006510069 | A | 3/2006 |

(Continued)

OTHER PUBLICATIONS

Jorge I. Marin-Hurtado, et al., "Perceptually Inspired Noise-Reduction Method for Binaural Hearing Aids," IEEE Transactions of Audio, Speech and Language Processing, IEEE, US, vol. 20, No. 4, May 1, 2012, pp. 1372-1382, XP011420577, ISSN: 1558-7916, DOI: 10.1109/TASL.2011.2179295 (Year: 2012).*

(Continued)

*Primary Examiner* — Pierre Louis Desir
*Assistant Examiner* — Mark R Hennings
(74) *Attorney, Agent, or Firm* — Loeb & Loeb LLP

(57) ABSTRACT

A method and an apparatus for reducing noise of mixed signal are disclosed. The method includes: separating a collected mixed signal to obtain a first signal and a second signal; selecting one of the first signal and the second signal as a current reference signal, and the other as a current expected signal; and performing adaptive filtering based on the selected current reference signal and the selected current expected signal. By the method and the apparatus, the noise can be reduced significantly or removed in a case where reference signal cannot be directly obtained from a hardware.

18 Claims, 1 Drawing Sheet

(56) References Cited

FOREIGN PATENT DOCUMENTS

JP 2008185834 A 8/2008

OTHER PUBLICATIONS

Chinese Office Action (with English language translation) for Application No. CN201810466106.9, dated Sep. 11, 2019, 12 pages.
Extended European Search Report for Application No. EP19173785.7, dated Sep. 6, 2019, 10 pages.
Jorge I Marin-Hurtado et al., "Perceptually Inspired Noise-Reduction Method for Binaural Hearing Aids", IEEE Transactions on Audio, Speech and Language Processing, IEEE, US, vol. 20, No. 4, May 1, 2012, pp. 1372-1382, XP011420577, ISSN: 1558-7916, DOI: 10.1109/TASL.2011.2179295.
Japanese Office Action (including English translation) for App. No. JP2019-091815, dated Feb. 8, 2021, 10 pages.

* cited by examiner

METHOD AND APPARATUS FOR REDUCING NOISE OF MIXED SIGNAL

TECHNICAL FIELD

This disclosure generally relates to the field of signal processing, and particularly to a method and an apparatus for reducing noise of a mixed signal.

BACKGROUND

Generally, a Signal-to-Noise Ratio of a signal can be improved by means of reducing steady-state noise on a single channel, performing beam forming or the like. However, the improvement of the Signal-to-Noise Ratio obtained by these manners may be still very limited, for example, there may be still lots of noise residual, even a filtering processing for reducing noise (for example, adaptive filtering) may not be performed because a reference signal cannot be obtained.

SUMMARY

According to one aspect of this disclosure, a method for reducing noise of a mixed signal is provided. The method comprises: separating a mixed signal to obtain a first signal and a second signal; selecting one of the first signal and the second signal as a current reference signal, and the other as a current expected signal; and performing adaptive filtering based on the selected current reference signal and current expected signal.

According to another aspect of this disclosure, a non-temporary storage medium with program instructions stored thereon is provided, the program instructions perform the above-described method when executed.

According to another aspect of this disclosure, an apparatus for reducing noise of a mixed signal is provided. The apparatus comprises one or more processor configured to perform the above-described method.

According to another aspect of this disclosure, an apparatus for reducing noise of a mixed signal is provided. The apparatus comprises a signal separator configured to separate a mixed signal to obtain a first signal and a second signal; a signal selector configured to select one of the first signal and the second signal as a current reference signal, and the other as a current expected signal; and an adaptive filter configured to perform adaptive filtering based on the selected current reference signal and current expected signal.

With the method and the apparatus according to embodiments of this disclosure, even in a case where an effective reference signal cannot be obtained directly from a hardware, residual noise can be removed effectively and the Signal-to-Noise Ratio can be improved significantly.

DESCRIPTION OF EMBODIMENT

The principle of a method and an apparatus according to embodiments of this disclosure is described by taking processing a speech signal as an example hereof. However, the method and the apparatus according to embodiments of this disclosure can be further applied to process other kinds of signals such as a biomedical signal, an array signal, an image signal, a mobile communication signal or the like.

For example, a signal collected by a sound collecting device (for example, a microphone array including one or more microphones, one or more analog-digital converters or the like) may be a mixed signal which may include a speech of one or more user and noise in environment.

For example, in a case where there is noise having directionality such as television noise, air conditioning noise or the like in the environment, the improvement of Signal-to-Noise Ratio that can be obtained by general signal processing manners such as reducing steady-state noise on a single channel, executing beam forming, signal blind processing or the like is very limited; also, the technical means which are able to be used for system identification, channel equalization, signal enhancement and prediction such as adaptive filtering cannot be used due to absence of effective reference signals.

In the method and the apparatus according to embodiments of this disclosure, a collected mixed signal is separated, and a current reference signal and a current expected signal are selected from the separated signals, and then adaptive filtering is performed based on the selected current reference signal and the selected current expected signal. Therefore, even in a case where an effective reference signal cannot be directly obtained from a hardware, residual noise can be removed effectively and the Signal-to-Noise Ratio can be improved significantly.

Figure 1:
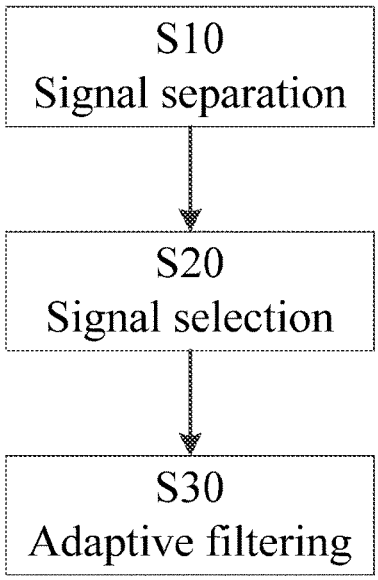
FIG. 1 illustrates a flow chart of a method for reducing noise of a mixed signal according to embodiments of this disclosure.

As shown in FIG. 1, the method for reducing noise of a mixed signal according to embodiments of this disclosure may include steps S10 to S30.

In step S10, separating a mixed signal to obtain a first signal and a second signal. Then, in step S20, selecting a current reference signal and a current expected signal from the obtained first signal and second signal. Then, in step S30, performing adaptive filtering based on the selected current reference signal and the selected current expected signal.

According to different embodiments, in step S10, a mixed signal can be separated by using different algorithms or methods. For example, the mixed signal can be performed blind source separation based on independent component analysis. Generally, the independent component analysis may require to know the certain number of sources in advance. Correspondingly, in one embodiment, the number of sources can be determined according to the number of operating microphones in a microphone array, for example. In other embodiments, in procedure of separating a mixed signal by using the blind source separation or other manners, the mixed signal may also be separated into a fixed number of signals (for example, any other fixed number equal to or larger than 2), irrespective of the actual number of sources.

In one embodiment, for one mixed signal including one or more frames, the entire mixed signal can be separated into at least two separated signals in step S10. In another embodiment, step S10 can be performed for each frame of the mixed signal respectively, for example, step S10 is performed for a received frame in real time when each frame is received, so that only a part of the mixed signal is separated at a time. In another embodiment, step S10 can be performed for a part of the mixed signal (for example, one or more continuous frames).

In one embodiment, a mixed signal may be separated into a pair of separated signals, or the mixed signal may be separated into multiple pairs of separated signals whose number corresponds to the number of sources or the number of adaptive filtering with respect to the number of sources or according to the number of adaptive filtering performed subsequently in step S30, for example. Then, the current reference signal and the current expected signal can be selected from each pair of separated signals respectively in step S20, and corresponding adaptive filtering is performed based on the selected current reference signal and current expected signal in step S30.

In other embodiments, a mixed signal may be separated into at least two separated signals as required. Then, a first signal is obtained or generated according to the obtained one or more separated signals, so that the first signal corresponds to a collection of the one or more separated signals, or corresponds to a composite signal of the one or more separated signals, or corresponds to a signal obtained by further processing the above collection of signal or composite signal. Similarly, a second signal is obtained or generated according to the one or more separated signals obtained, so that the second signal corresponds to a collection of the one or more separated signals, or corresponds to a composite signal of the one or more separated signals, or corresponds to a signal obtained by further processing the above collection of signals or composite signal.

According to different embodiments, the one or more separated signals used for generating the first signal and the second signal respectively may not be completely identical, and may or may not have intersection of separated signals.

That is, according to different embodiments, each signal of each pair of signals corresponding to the adaptive filtering in step S30 may include one or more signals of a plurality of signals separated from the mixed signal or originate from one or more signals of a plurality of signals separated from the mixed signal; and as a whole, the number of the first signal in step S10 may be one or more, and the number of the second signal may be one or more too.

For example, assuming that the mixed signal is obtained by a microphone array including three microphones and the reference signal cannot be directly obtained by a hardware, then in a case where a signal collected by each microphone (or a signal from each source) respectively is desired to be removed or reduced noise, the mixed signal obtained can be separated into a plurality of signals, for example, 2, 3 or more.

Then, for each microphone, the first signal can be obtained or formed according to one signal or a set of signals (for example, a composite signal determined as one or more signals relating to the microphone, or a collection of one or more signals), and the second signal can be obtained or formed according to additional one signal or a set of signals (for example, a collection or composite signal of all other signal except the signal used as the first signal or the signal used to form the first signal), so as to obtain one pair of corresponding first signal and second signal from each microphone, and to obtain one or more first signals and one or more second signals as a whole.

Hereinafter, for convenience of description, the principle of the method according to embodiments of this disclosure is described by taking the mixed signal being separated into two signals s1($n$) and s2($n$) as an example.

After step S10, step S20 and S30 can be performed based on each frame of the signal, that is, it assumes that, for example, two signals s1($n$) and s2($n$) are obtained by blind source separation in step S10, where $1 \le n \le KN$, K is the number of frames in each of the signals s1($n$) and s2($n$) (if the blind source separation is performed for each frame of the mixed signal in step S10, then K=1), N is the number of sampling points in each frame, then, step S20 and S30 can be performed for each pair of signals s1($n_k$) and s2($n_k$) (where $(k-1)N+1 \le n_k \le kN$) for each k (that is, each current frame) from 1 to K.

According to embodiments of this disclosure, in step S20, which one of the signals s1($n$) and s2($n$) can be selected currently as the reference signal for the adaptive filtering is determined according to energy information associated with the signals s1($n_k$) and s2($n_k$).

In one embodiment, the current energy of current frame s1($n_k$) or s2($n_k$) can be determined according to a sum of squares of amplitudes of all sampling points in the current frame s1($n_k$) or s2($n_k$) of the signal s1($n$) or s2($n$).

For example, current energy $E_1(k)$ or $E_2(k)$ of the current frame s1($n_k$) or s2($n_k$) of the signal s1($n$) or s2($n$) can be calculated according to the following corresponding equation:

$$E_1(k)=\Sigma_{i=(k-1)N+1}^{kN} sa1(i)^2 \tag{1}$$

$$E_2(k)=\Sigma_{i=(k-1)N+1}^{kN} sa2(i)^2 \tag{2}$$

Where sa1($i$) or sa2($i$) represents an amplitude of sampling point i in the current frame s1($n_k$) or s2($n_k$) of the signal s1($n$) or s2($n$).

Then, current longtime energy of the signal s1($n$) or s2($n$) relating to the current frame s1($n_k$) or s2($n_k$) can be determined according to the weighted sum of the current energy $E_1(k)$ or $E_2(k)$ of the current frame s1($n_k$) or s2($n_k$) and previous longtime energy in a predetermined time period before the current frame s1($n_k$) or s2($n_k$) of the signal s1($n$) or s2($n$). In one embodiment, a sum of weight for the current energy $E_1(k)$ or $E_2(k)$ and weight for the previous longtime energy may be 1.

In one embodiment, the previous longtime energy may be average energy in a predetermined time period before the current frame s1($n_k$) or s2($n_k$) of the signal s1($n$) or s2($n$).

In another embodiment, the current longtime energy $E_{L1}(k)$ or $E_{L2}(k)$ of the signal s1($n$) or s2($n$) relating to the current frame s1($n_k$) or s2($n_k$) can be calculated recursively according to the following corresponding equation:

$$E_{L1}(k)=a_1E_{L1}(k-1)+b_1E_1(k) \tag{3}$$

$$E_{L2}(k)=a_2E_{L2}(k-1)+b_2E_2(k) \tag{4}$$

Where $E_{L1}(k-1$or $E_{L2}(k-1)$ is the previous longtime energy before the current frame s1($n_k$) or s2($n_k$), $E_{L1}(\mathbf{0})$ and $E_{L2}(\mathbf{0})$ may be set as an initial value (for example, 0 or a certain empirical value) in advance. For $E_{L1}(k)$, $a_1$ and $b_1$ are weights for $E_{L1}(k-1)$ and $E_1(k)$ respectively. In one embodiment, $a_1$ and $b_1$ may be larger than or equal to 0. In one embodiment, the sum of $a_1$ and $b_1$ may be equal to 1. According to different embodiments, with respect to $E_{L1}(k)$ of different frame (that is, different value of k), selected weights $a_1$ and $b_1$ may be identical or different. Similarly, for $E_{L2}(k)$, $a_2$ and $b_2$ are weights for $E_{L2}(k-1)$ and $E_2(k)$ respectively. In one embodiment, $a_2$ and $b_2$ may be larger than or equal to 0. In one embodiment, the sum of $a_2$ and $b_2$ may be equal to 1. According to different embodiments, for $E_{L2}(k)$ of different frame (that is, different value of k), selected weights $a_2$ and $b_2$ may be identical or different.

Then, a current energy ratio of the signal s1($n$) or s2($n$) can be calculated according to the current energy $E_1(k)$ or $E_2(k)$ and the current longtime energy $E_{L1}(k)$ or $E_{L2}(k)$. In one embodiment, the current energy ratio $R_1(k)$ or $R_2(k)$ of the signal s1($n$) or s2($n$) can be calculated according to the corresponding following equation:

$$R_1(k)=E_1(k)/(E_{L1}(k)+\Delta_1) \quad (5)$$

$$R_2(k)=E_2(k)/(E_{L2}(k)+\Delta_2) \quad (6)$$

Where $\Delta_1$ or $\Delta_2$ is a corresponding adjustment amount which may be an arbitrary constant (including 0), for example, an arbitrary small positive number (for example, $10^{-6}$), as long as that a division by zero error does not occur when a division operation is performed. According to different embodiments, $\Delta_1$ and $\Delta_2$ may be identical or different.

Then, which one of the signals s1($n$) and s2($n$) is selected as the current reference signal at the time of k-th frame is determined according to the obtained current energy ratio $R_1(k)$ of the signal s1($n$) and the current energy ratio $R_2(k)$ of the signal s2($n$).

In one embodiment, which one of signals s1($n$) and s2($n$) is selected as the current reference signal at the time of k-th frame is determined according to the following table 1.

TABLE 1

| Condition 1 | Condition 2 | Current reference signal |
|---|---|---|
| $R_1(k) \geq TH$ and $R_2(k) \geq TH$ | $R_1(k) < R_2(k)$ | s1(n) |
| | $R_1(k) > R_2(k)$ | s2(n) |
| | $R_1(k) = R_2(k)$ | Selected arbitrarily or same as a previous frame (that is, remain identical) |
| others | — | Selected arbitrarily or same as a previous frame (that is, remain identical) |

According to table 1, the current energy ratio $R_1(k)$ and $R_2(k)$ are compared with a threshold TH respectively (condition 1). In different embodiments, the threshold TH can be set in advance according to the type of signal processed and the actual requirement. For example, for a normalized aural signal, the threshold TH may be $9*10^{-6}$.

In a case where $R_1(k) \geq TH$ and $R_2(k) \geq TH$, $R_1(k)$ and $R_2(k)$ can be further compared (condition 2), so as to select which one of the signals s1($n$) and s2($n$) as the current reference signal according to the further comparison result.

In a case where the condition "$R_1(k) \geq TH$ and $R_2(k) \geq TH$" is not satisfied, either one of the signals s1($n$) and s2($n$) can be selected as the current reference signal, or the current reference signal can be determined according to the selection at the time of a previous frame (that is, the k−1-th frame). For example, if the signal s1($n$) is selected as the reference signal at the time of the previous frame, then for the current frame, the signal s1($n$) is continuously used as the current reference signal, otherwise, the signal s2($n$) can be used as the current expected signal. In other examples, if the signal s1($n$) is selected as the reference signal at the time of the previous frame, then for the current frame, the signal s2($n$) can be used as the current reference signal as required, and the signal s1($n$) is used as the current expected signal.

In a case where which one of the signals s1($n$) and s2($n$) is selected as the current reference signal at the time of the current frame is determined according to the selection at the time of the previous frame, if the current frame of the signal s1($n$) and the current frame of the signal s2($n$) are an initial frame of the signal s1($n$) and an initial frame of the signal s2($n$) respectively, that is, an index value k of the current frame is 1, then either one of the signals s1($n$) and s2($n$) can be set as the current reference signal initially. In one embodiment, such initialized setting may be completed before the examination defined in the table 1 for the initial frame (k=1) of the signal s1($n$) and the initial frame (k=1) of the signal s2($n$) (for example, at the time of system initialization).

In other embodiments, one of the signals s1($n$) and s2($n$) can be selected fixedly as the current reference signal at the time of processing the initial frame of the signal s1($n$) and the initial frame of the signal s2($n$) or system initialization. For example, the signal s1($n$) is selected fixedly as the current reference signal.

When one of the signals s1($n$) and s2($n$) is selected as the current reference signal, the other becomes the current expected signal correspondingly.

After selecting the current reference signal and the current expected signal at the time of k-th frame (the current frame), the method may proceed to step S30, so as to perform the adaptive filtering according to the selected current reference signal and current expected signal.

For example, an adaptive filtering in time domain can be carried out by using a M dimensional adaptive filter, wherein a coefficient of the filter may be $W(j)=[w1, w2, \ldots w_M]^T$, the corresponding initial value $W(0)=[0,0, \ldots, 0]^T$, T is a transposing operation.

In this example, for each sampling point p ($1 \leq n \leq N$) in each current frame (that is, the k-th frame), the corresponding error value obtained by the adaptive filtering is $e(p)=d(p)-W(p-1)^T X(p)$, where $X(p)=[x(p), x(p-1), \ldots, x(p-M+1)]$, and d(•) and x(•) represent sampling points in the current reference signal and the current expected signal respectively. If the index value of a certain x(•) in X(p) is less than or equal to 0, then the value of the x(•) may be 0. For example, if M=4, p=2, then $X(2)=[x(2), x(1), x(0), x(-1)]=[x(2), x(1), 0, 0]$. The coefficient of the adaptive filter can be adjusted to $W(p)=W(p-1)+\mu e(p) X(p-1)$, where μ is an adjustment coefficient, for example, a stride of a single adjustment.

Therefore, at the time of k-th frame, the error signal at the time of k-th frame can be determined according to the current reference signal and the current expected signal (and potentially, all previous reference signals), further noise reduction can be implemented according to the obtained error signal.

In the above example, the adaptive filtering in time domain is adopted in step S30. However, this disclosure is not limited to the type and implementing mode of the adaptive filtering. For example, in other embodiments, an adaptive filtering in frequency domain can be adopted, and the linear or nonlinear adaptive filtering can be adopted. Further, this disclosure is not limited to the dimension and adjusting mode of coefficient of the adopted adaptive filter.

With the method according to embodiments of this disclosure, even in a case where an effective reference signal cannot be directly obtained from a hardware, residual noise can be removed effectively. Experimental data indicate that the method according to embodiments of this disclosure can improve the Signal-to-Noise Ratio significantly.

Figure 2:
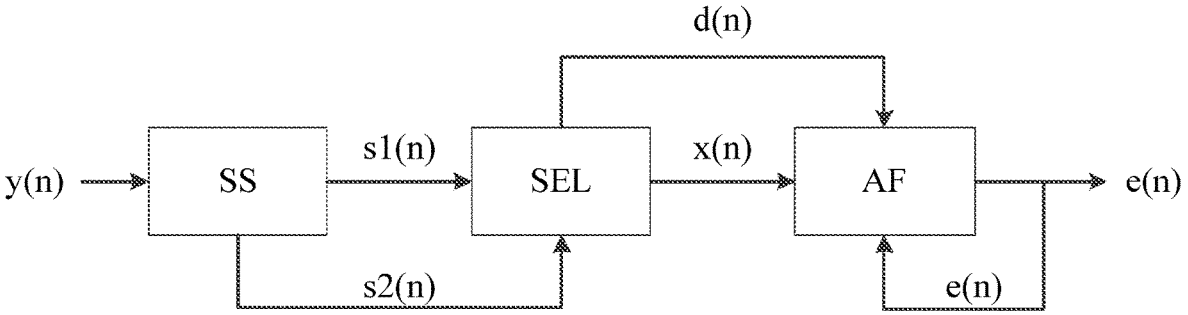
FIG. 2 illustrates a structural diagram of an apparatus for reducing noise of a mixed signal according to embodiments of this disclosure.

FIG. 2 illustrates a structural diagram of an apparatus which is able to implement the above-described method according to embodiments of this disclosure. As shown in FIG. 2, the apparatus according to this disclosure may include a signal separator SS, a signal selector SEL and an adaptive filter AF.

The signal separator SS can be configured to separate a received mixed signal y(n) to obtain signals s1($n$) and s2($n$), that is, perform step S10 of the above-described method. In one embodiment, the signal separator SS can be configured to perform blind source separation on the mixed signal based on an independent component analysis, and correspondingly may include a hybrid matrix circuit, a learning network and an algorithm processor configured to execute the learning algorithm. In other embodiments, the signal separator SS may include one or more processors (for example, general processor) to perform step S10 of the above-described method.

The signal selector SEL may be configured to select one of the signals s1(*n*) and s2(*n*) as the current reference signal x(n), and correspondingly the other of the signals s1(*n*) and s2(*n*) as the current expected signal d(n), for example, in unit of frame, that is, to perform step S20 of the above-described method. In one embodiment, the signal selector SEL may include: an energy detector (not shown) configured to detect energy of each sampling point and calculate energy information required in step S20; a comparator (not shown) configured to compare energy ratio information from the energy detector; and a signal switch configured to establish and switch connections among the signals s1(*n*) and s2(*n*) and an input end of the reference signal and an input end of the expected signal of the adaptive filter AF according to an output result of the comparator. In other embodiments, the signal selector SEL may comprise one or more processor (for example, general processors) to perform step S20 of the above-described method.

The number of the adaptive filter AF may be one or more, and each adaptive filter AF can be configured to perform adaptive filtering according to the current reference signal x(n) from the input end of the reference signal, the current expected signal d(n) from the input end of the expected signal and the error signal e(n) returning from error signal output end itself. In other embodiments, the adaptive filter AF may include one or more processors (for example, general processors), and can implement virtual adaptive filtering or perform an adaptive filtering algorithm by such one or more processors.

According to other embodiments, the apparatus which is able to implement the method according to embodiments of this disclosure may include one or more processors (for example, general processors), and can configure such one or more processors to perform steps of the method according to embodiments of this disclosure.

In one embodiment, the apparatus may also include a memory. The memory may include various kinds of computer readable and writable storage mediums, for example, a volatile memory and/or a nonvolatile memory. The volatile memory may include, for example, a random access memory (RAM) and/or a cache memory (cache) or the like. The nonvolatile memory may include, for example, a read-only memory (ROM), a hard disk, a flash memory or the like. The readable and writable storage medium may include, but not limited to, for example, an electronic, magnetic, optical, electromagnetic, infrared or semiconductor system, apparatus, or device, or any suitable combination of the foregoing. The memory may include program instructions which can perform the method according to embodiments of this disclosure when executed.

In addition, the apparatus may also include an input/output interface and a signal collecting device or component such as a microphone array or an analog-digital converter.

Some embodiments of this disclosure have been described, however, these embodiments are only presented as example, but not intend to limit the protection scope of this disclosure. Actually, the method and the apparatus described above can adopt various kinds of other forms to implement. Further, the method and the apparatus described above can be made various kinds of omission, replacement and variation in form in case of not departing from the range of this disclosure.

What is claimed is:

1. A method for reducing noise of a mixed signal comprising:

separating the mixed signal to obtain a first signal and a second signal;

selecting one of the first signal and the second signal as a current reference signal and the other of the first signal and the second signal as correspondingly a current expected signal; and performing adaptive filtering based on the current reference signal and the current expected signal wherein the selecting comprises:

calculating first current energy of a first current frame of the first signal;

calculating first current longtime energy of the first signal relating to the first current frame;

calculating a first current energy ratio according to the first current energy and the first current longtime energy;

calculating second current energy of a second current frame of the second signal;

calculating second current longtime energy of the second signal relating to the second current frame;

calculating a second current energy ratio according to the second current energy and the second current longtime energy; and setting the first signal or the second signal as the current reference signal according to the first current energy ratio and the second current energy ratio.

2. The method according to claim 1, wherein, the first current energy is a sum of squares of amplitudes of all sampling points in the first current frame, and the second current energy is a sum of squares of amplitudes of all sampling points in the second current frame.

3. The method according to claim 1, wherein, the first current longtime energy is a weighted sum of the first current energy and a first previous longtime energy, the first previous longtime energy being previous longtime energy of the first signal corresponding to a previous frame of the first current frame, and the second current longtime energy is a weighted sum of the second current energy and second previous longtime energy, the second previous longtime energy being previous longtime energy of the second signal corresponding to a previous frame of the second current frame.

4. The method according to claim 1, wherein, the first current energy ratio is a ratio of the first current energy with a first value, the first value including a value of the first current longtime energy, and the second current energy ratio is a ratio of the second current energy with a second value, the second value including a value of the second current longtime energy.

5. The method according to claim 1, wherein the setting comprises:

in a case where at least one of the first current energy ratio and the second current energy ratio is larger than or equal to a threshold, if the first current energy ratio is less than the second current energy ratio, setting the first signal as the current reference signal, and if the first current energy ratio is larger than the second current energy ratio, setting the second signal as the current reference signal.

6. The method according to claim 1, further comprising:

if the first signal was selected as the current reference signal at the time of the previous frame of the first current frame, initially setting the first signal as the current reference signal, otherwise, initially setting the second signal as the current reference signal.

7. The method according to claim 1, further comprising:

if the first current frame and the second current frame are respectively an initial frame of the first signal and an initial frame of the second signal, initially setting either one of the first signal and the second signal as the current reference signal.

8. The method according to any one of claims 1 to 7, wherein the separating comprises:

performing blind source separation on the mixed signal based on independent component analysis to generate at least two separated signals; and obtaining the first signal and the second signal based on the at least two separated signals.

9. A non-temporary storage medium with program instructions stored thereon, wherein the program instructions perform the method according to claim 1 when executed.

10. An apparatus for reducing noise of mixed signal comprising: one or more processors configured to perform the method according to claim 1.

11. An apparatus for reducing noise of a mixed signal comprising:

a signal separator configured to perform a blind source separation on the mixed signal to obtain a first signal and a second signal;

a signal selector configured to select one of the first signal and the second signal as a current reference signal, and the other as correspondingly a current expected signal; and an adaptive filter configured to perform adaptive filtering based on the current reference signal and the current expected signal wherein the signal selector is configured to:

calculate first current energy of a first current frame of the first signal;

calculate first current longtime energy of the first signal relating to the first current frame;

calculate a first current energy ratio according to the first current energy and the first current longtime energy;

calculate second current energy of a second current frame of the second signal;

calculate second current longtime energy of the second signal relating to the second current frame;

calculate a second current energy ratio according to the second current energy and the second current longtime energy; and set the first signal or the second signal as the current reference signal according to the first current energy ratio and the second current energy ratio.

12. The apparatus according to claim 11, wherein, the first current energy is a sum of squares of amplitudes of all sampling points in the first current frame, and the second current energy is a sum of squares of amplitudes of all sampling points in the second current frame.

13. The apparatus according to claim 11, wherein, the first current longtime energy is a weighted sum of the first current energy and first previous longtime energy, the first previous longtime energy being previous longtime energy of the first signal corresponding to a previous frame of the first current frame, and the second current longtime energy is a weighted sum of the second current energy and second previous longtime energy, the second previous longtime energy being previous longtime energy of the second signal corresponding to a previous frame of the second current frame.

14. The apparatus according to claim 11, wherein, the first current energy ratio is a ratio of the first current energy with a first value, the first value including a value of the first current longtime energy, and the second current energy ratio is a ratio of the second current energy with a second value, the second value including a value of the second current longtime energy.

15. The apparatus according to claim 11, wherein the signal selector is configured to in a case where at least one of the first current energy ratio and the second current energy ratio is larger than or equal to a threshold, set the first signal as the current reference signal if the first current energy ratio is less than the second current energy ratio, and set the second signal as the current reference signal if the first current energy ratio is larger than the second current energy ratio.

16. The apparatus according to claim 11, wherein the signal selector is further configured to initially set the first signal as the current reference signal if the first signal was selected as the current reference signal previously at the time of the previous frame of the first current frame, otherwise, initially set the second signal as the current reference signal.

17. The apparatus according to claim 11, wherein the signal selector is further configured to initially set either one of the first signal and the second signal as the current reference signal, if the first current frame and the second current frame are respectively an initial frame of the first signal and an initial frame of the second signal.

18. The apparatus according to claim 11, wherein the signal separator is configured to preform blind source separation on the mixed signal based on independent component analysis to generate at least two separated signals, and obtain the first signal and the second signal based on the at least two separated signals.

* * * * *